US005785311A

United States Patent [19]

Doery

[11] Patent Number: 5,785,311

[45] Date of Patent: Jul. 28, 1998

[54] SHEET SEPARATING AND FEEDING DEVICE

[75] Inventor: Michael S. Doery, Monroe, Conn.

[73] Assignee: Pitney Bowes Inc., Stamford, Conn.

[21] Appl. No.: 703,922

[22] Filed: Aug. 22, 1996

[51] Int. Cl.[6] ..... B65H 7/08

[52] U.S. Cl. ..... 271/110; 271/113; 271/118; 271/123; 271/10.03; 271/10.11

[58] Field of Search ..... 271/10.03, 18.11, 271/110, 113, 118, 123

[56] References Cited

U.S. PATENT DOCUMENTS

| | | | |
|---|---|---|---|
| 4,165,870 | 8/1979 | Fallon et al. . | |
| 4,395,033 | 7/1983 | Janssen et al. . | |
| 4,398,709 | 8/1983 | Janssen et al. . | |
| 4,451,028 | 5/1984 | Holmes et al. | 271/110 |
| 4,887,810 | 12/1989 | Grutzmacher et al. . | |

FOREIGN PATENT DOCUMENTS

| | | | |
|---|---|---|---|
| 405319592 A | 12/1993 | Japan | 271/123 |

*Primary Examiner*—H. Grant Skaggs
*Attorney, Agent, or Firm*—Robert H. Whisker; David E. Pitchenik

[57] ABSTRACT

A sheet separating and feeding device for use as a component of a sheet processing apparatus is disclosed in which a first feeding device acts on the top of a stack of sheets to feed the top sheet toward a take away feeder for removal from the stack, during which a retaining force is applied to the upper surface of the exposed trailing edge portion of the next to top sheet to apply a retaining force thereto and to the rest of the stack, and simultaneously lifts the first feeding device off of the top sheet to remove the normal force from the weight of this device from the stack. When the top sheet is entirely removed from the stack, the first feeding device is lowered to engage the new top sheet and the retaining force is removed therefrom so that it can be fed to the take away feeder.

6 Claims, 4 Drawing Sheets

SHEET SEPARATING AND FEEDING DEVICE

BACKGROUND OF THE INVENTION

This invention relates generally to the field of sheet separating and feeding devices, and more particularly to an improvement in sheet separating and feeding devices that utilize the principle of directional wave generation to cause the top sheet of a stack to separate from the next lower sheet and move toward a feeding device for removal of the sheet from the stack.

Sheet separating and feeding devices have long been well known in sheet processing applications far too numerous to mention, and with the advent of high technology business machines for printing on, sorting, collating, folding, stacking, and otherwise processing a plurality of individual sheets at a high rate of speed, the speed and reliability of sheet separating and feeding devices have become critically important to the commercial success of business machines that perform any, as well as others, of the foregoing processing functions.

One application in particular where these sheet separating and feeding devices are critical is that of high speed inserting machines which feed various types of paper materials from stacks thereof to an accumulator, which collects and arranges the materials into collations suitable for insertion into envelopes, typically for the purpose of mailing. Since it is possible for several different items of the materials, originating at different sources, to be arranged into a single collation, the timing of the feeding of the individual materials is critical so that they all arrive at the accumulator at a precise moment in order to be arranged in a predetermined order. If there is a delay in the timing of feeding of one of the materials, or if a misfeed or a double feed occurs, the proper timing of the sequence of feeding of the various materials is disrupted, with the result either that improper collations are formed in the accumulator, or that jams occur and the machine shuts down.

Many different types of sheet feeding machines have been developed to solve these problems and they have met with varying degrees of success. However, they have been particularly successful in achieving the desired purpose only when a particular stack of material is composed of the same type of paper material. Thus, if a particular stack of material contained only 20 pound bond, smooth surfaced paper, for example, the feeding device, once adjusted for this type of material, might work very well and consistently feed sheets in properly timed sequence with the timing of sheets being fed from other stacks of materials. But, if a stack containing different types of paper were put into one of these feeding machines, the timing of feeding of individual sheets would change due to variations in the characteristics of the sheets of paper. Typical examples of these characteristics are the weight of the paper, degree of surface smoothness, surface coatings, etc.

There is one prior art type of feeder which has been found to be very effective in consistently feeding various types of sheets of paper in a single stack, and which is disclosed and claimed in U.S. Pat. No. 4,165,870, issued Aug. 28, 1979 to Fallon et al and assigned to International Business Machines Incorporated. This type of feeder generates a directional wave pattern in a stack of sheets which has the effect of shingling a plurality of sheets in the upper portion of the stack so that they become separated from one another, and are moved toward another feeding device until the top sheet from the stack reaches that feeding device and is withdrawn.

While this feeding device is considerably more reliable than friction feeders, it is still subject to occasional double feeding because of variations in the nature of the paper as mentioned above. The problem is that even after some degree of separation between the top sheet and the next sheet resulting from the relative degree of movement of these sheets from the directional wave motion has occurred, when the top sheet is finally engaged by the withdrawal feeding device, the next sheets may be pulled along with the top sheet, thereby resulting in a double feed, which either causes a paper jam or is merely detected, either of which events causes the machine to stop operating.

Thus, there is a need for an even more effective and reliable feeding device which will feed sheets from a stack containing sheets having various types of physical characteristics without the risk of two or more sheets being fed simultaneously.

BRIEF SUMMARY OF THE INVENTION

The sheet separating and feeding device of the present invention at least obviates if not entirely eliminates the disadvantages of the prior art directional wave generation type feeding device. In principle, this is accomplished by imposing a retaining force on the exposed trailing edge portion of the next to top sheet after the top sheet has been slightly advanced toward the withdrawal feeding device, while simultaneously imposing a lifting force on the directional wave generating device so that it is rendered inoperative while the top sheet is being withdrawn from the stack.

Thus, in its broader aspects, the present invention is a sheet separating and feeding device for separating the top sheet from a stack of sheets and feeding it in a desired direction, and comprises means for supporting a stack of sheets, first feeding means for feeding the top sheet from the stack to an advanced position in which a trailing edge portion of the next to top sheet is exposed beyond the trailing edge of the top sheet, and means for supporting the first feeding means in overlying relationship with the stack of sheets so that the first feeding means normally contacts the top sheet of the stack. A second feeding means is disposed adjacent the supporting means for grasping the leading edge of the top sheet of the plurality of shingled sheets and for withdrawing the top sheet from the stack. A retaining means is provided for engaging the exposed trailing edge portion of the next to top sheet for imposing a retaining force thereon and on additional sheets thereunder, and for simultaneously disengaging the first feeding means from the top sheet while the second feeding means withdraws the top sheet from the stack. Finally, there is a control means for controlling the operation of the first and second feeding means and the retaining means such that the first feeding means is operative to feed the top sheet when the retaining means is inoperative, and the first feeding means becomes inoperative and the retaining means becomes operative when the top sheet is grasped by the second feeding means for removal from the stack, whereby the retaining means prevents the second feeding means from withdrawing more than one sheet at a time from the stack.

In some of its more limited aspects, the mounting means includes means for supporting the first feeding means for limited vertical movement relative to the stack of sheets sufficient to permit the first feeding means to be periodically disengaged from the top sheet, and for supporting the retaining means adjacent the trailing edge of the top sheet relative to the direction of movement of the top sheet. The retaining means is disposed on the mounting means relative to the trailing edge of the top sheet such that the retaining means is engageable with the exposed upper surface of the trailing edge portion of the next to top sheet to retain the next to top sheet from movement when the top sheet is engaged by the second feeding means. The retaining means comprises sheet contact means mounted for limited vertical movement relative to the top sheet between an inoperative position in which the contact means is out of contact with the next to top sheet and an operative position in which the contact means is engaged with the exposed upper surface of the next to top sheet. The mounting means comprises support means for both the first feeding means and the retaining means, the support means being mounted on the sheet separating and feeding device for limited vertical movement relative to the top sheet, and the vertical movement of the contact means between the inoperative position to the operative position is sufficient to raise the support means a sufficient distance to disengage the first feeding means from the top sheet. Finally, the control means comprises means for activating the wave generating means upon demand to feed the top sheet toward the feeding means, sensing means for sensing when the lead edge of the top sheet reaches a predetermined position, and means responsive to operation of the sensing means for activating the retaining means to move the contact member from the inoperative position to the operative position thereby raising the support means to deactivate the first feeding means.

Having briefly described the general nature of the present invention, it is a principal object thereof to provide a sheet separating and feeding device that effectively separates and feeds only the top sheet from a stack of sheets regardless of the physical characteristics of the sheets.

Another object of the present invention is to provide a sheet separating and feeding device that feeds a top sheet of a stack to an advanced position to permit a retaining device to engage the upper surface of a trailing edge portion of the next to top sheet to retain it and succeeding sheets in the stack while the top sheet is fed away from the stack.

Still another object of the present invention is to provide a sheet separating and feeding device that simultaneously disengages a directional first feeding device from the top sheet of the stack after a feeding device engages the top sheet so as to substantially eliminate frictional force between the top sheet and the sheet next beneath the top sheet.

These and other objects and advantages of the present invention will become more apparent from an understanding of the following detailed description of a presently preferred mode of carrying out the invention, when considered in conjunction with the accompanying drawings.

DETAILED DESCRIPTION OF THE INVENTION

Figure 1:
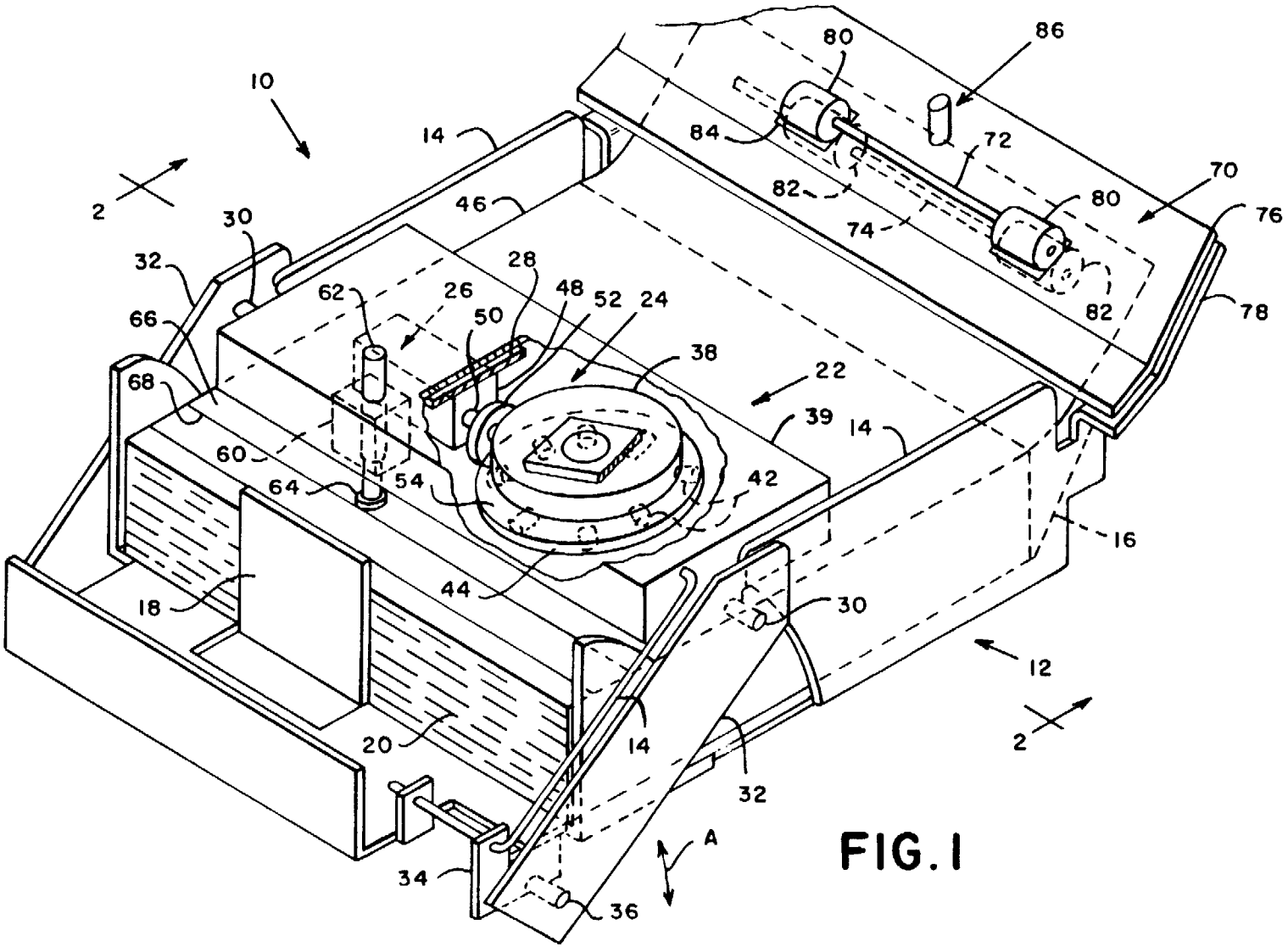
FIG. 1 is a perspective view of the sheet separating and feeding device of the present invention.

Referring now to the drawings, and particularly to FIG. 1 thereof, the sheet separating and feeding device of the present invention is designated generally by the reference numeral 10, and is seen to comprise a suitable receptacle, indicated generally by the reference numeral 12, which has side walls 14, a front wall 16 and an adjustable rear guide 18, for holding a stack of sheets 20. It will be understood that the sheet separating and feeding device 10 is an integral assembly which can be used in any type of sheet processing apparatus in which a stack of sheets is stored in a storage location and from which sheets are fed seriatim from the storage location to another location for some type of processing. A typical example of such apparatus would be an envelope inserting apparatus, in which a plurality of stacks of sheets are stored, and from which individual sheets are fed in a predetermined sequence to a accumulator to form a collation, then to a folding machine and then to an inserting machine in which the collation is inserted into an envelope. The present invention is concerned only with the sheet separating and feeding device in which the stack of sheets is stored, and further description and illustration of equipment in which this device is utilized is not deemed necessary for a complete understanding of the present invention.

The device 10 includes a vertically movable support means, indicated generally by the reference numeral 22, for supporting a first feeding means which in a presently preferred form of the invention is a directional wave generating means, indicated generally by the reference numeral 24, and a retaining means, indicated generally by the reference numeral 26, both of which are more fully described below. The support means 22 includes an elongate supporting member 28 which extends across the width of the sheet stack receptacle 12, and further includes stub shafts 30 or other suitable means by which the supporting member 28 is rotatably supported by a pair of arms 32. The arms 32 are also suitably rotatably supported on a portion 34 of the receptacle 12 as by stub shafts 36 so that the arms 32 can oscillate in the direction of the arrow A about the stub shafts 36 as an axis, the means by which the supporting member 28 is caused to oscillate being fully explained below. A suitable cover member 39 is connected to the elongate supporting member 28 and encloses the wave generating means 24, the drive means for the wave generating means (described below), a major portion of the retaining means 26 and the elongate supporting member 28. A rod 41 is connected at one end to a side wall of the cover member 39 and at the other end to the portion 34 of the receptable 12 to form a parallelgram with the arm 32 so that when the arm 32 is oscillated about the shaft 36, the cover member 39 and the elongate supporting member 28 remain in a horizontal orientation, as more fully described below.

Figure 2:
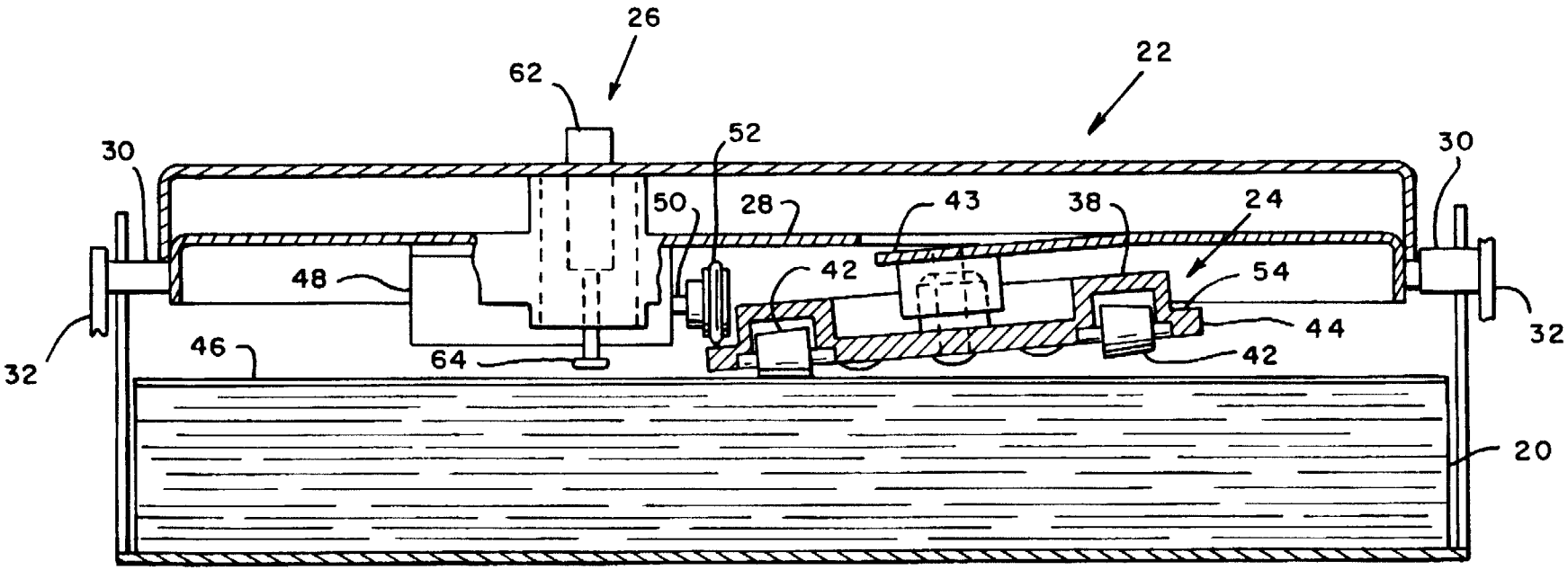
FIG. 2 is a lateral section across the sheet separating and feeding device shown in FIG. 1, taken on the line 1—1 of FIG. 1.

The directional wave generating means 24 is similar, but not equivalent to, the aforementioned U.S. Pat. No. 4,165, 870; the specification and drawings of which are incorporated herein by reference, in that the current invention provides a more reliable feed by applying pressure to the trailing edge of the media. Thus, for the purpose of understanding the present invention, it is sufficient to note only that the wave generating means 24 includes a frame 38 which is suitably attached to a bent tab portion 43 of the supporting member 28 as best seen in FIG. 2. The wave generating means 24 further includes a plurality of rollers 42 which are freely rotatably supported in a disc 44 which in turn is rotatably supported in the frame 38 so that the rollers 42 contact the top sheet 46 when the supporting member 28 is in its lowermost position as seen in FIG. 1.

As seen in FIG. 2, the frame 38 is attached to the bent tab portion 43 of the supporting member 28 so that the upwardly extending axis thereof is disposed at a slight angle to vertical, with the result that the frame 38 lies in a plane that is at a correspondingly slight angle to the upper surface of the top sheet 46 so that only one roller 42 at a time is in contact with the top sheet 46. A motor 48 is also suitably mounted on the supporting member 28 and has a drive shaft 50, and a drive wheel 52 is mounted on the outer end of the shaft 50 which engages with the upper surface 54 of the disc 44, so that rotation of the drive wheel 52 by the motor 50 rotates the disc 44 to cause successive rollers 42 to momentarily engage the top sheet 46 of the stack 20.

The retaining means 26 includes a contact member mounted for limited vertical movement relative to the top sheet between an inoperative position in which the contact means is out of contact with the next to top sheet and an operative position in which the contact means is engaged with the exposed upper surface of the next to top sheet. In the preferred embodiment, the retaining means 26 comprises a solenoid 60 suitably fixedly connected to the supporting member 28, the solenoid 60 having a plunger 62 which is normally maintained in an up position, as shown in FIG. 1. The lower end of the plunger 62 has a suitable pressing pad 64 for engaging the upper surface portion 66 of the next to top sheet 68 that is exposed beyond the trailing edge of the top sheet 46 after it has been fed to a predetermined position as further described below. The actual position of the solenoid 60 along the platform 28 is not important so long as the pressing pad 64 engages the exposed portion 66 of the next to top sheet 68.

The device 10 includes a feeding means, indicated generally by the reference numeral 70, and preferably comprises upper and lower shafts 72 and 74 which are suitably mounted for rotation on upper and lower guide plates 76 and 78 respectively, each of the shafts having cooperating rollers 80 and 82 thereon which engage each other through apertures 84 formed in the guide plates. Any suitable means may be provided for driving the rollers 80 and 82 so as to feed successive sheets therebetween.

The device 10 further includes a suitable sheet sensing device, indicated generally by the reference numeral 86, which is positioned just slightly downstream from the nip of the feed rollers 80 and 82 so that the sensing device 86 can ascertain when the leading edge of the sheet 46 reaches a predetermined position, generally referred to as a staging position.

Figure 3:
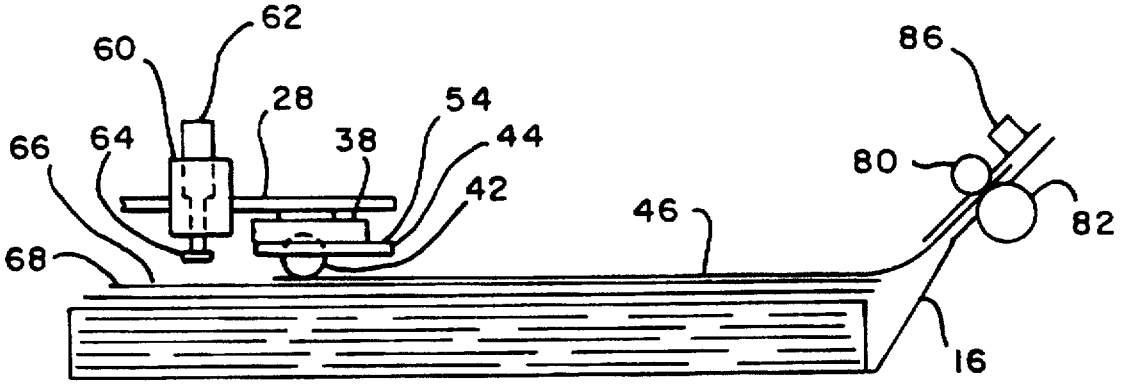
FIG. 3 is a schematic diagram of the sheet separating and feeding device of the present invention showing the top sheet of the stack in the normal staged position it occupies when the separating and feeding device is not operating.

The operation of the sheet separating and feeding device 10 will now be explained with reference to FIGS. 3 through 7. FIG. 3 represents the home position of the sheet separating and feeding component of the device 10, in which it is seen that the top sheet 46 has been pre-fed to the advanced or staging position in which the leading edge of the top sheet 46 has just reached the sensing means 86, and the remaining sheets of a predetermined plurality of sheets are disposed in a shingled relationship. It is also seen that in this position the plunger 62 of the solenoid 60 is in its up or inoperative position with the pressing pad 64 raised above the exposed surface portion 66 of the next to top sheet 68. It will be understood that the operation of the feed rollers 80 and 82, the motor 46 for driving the disc 44 of the wave generating device 24 and the solenoid 60 are all under the control of the microprocessor.

Figure 4:
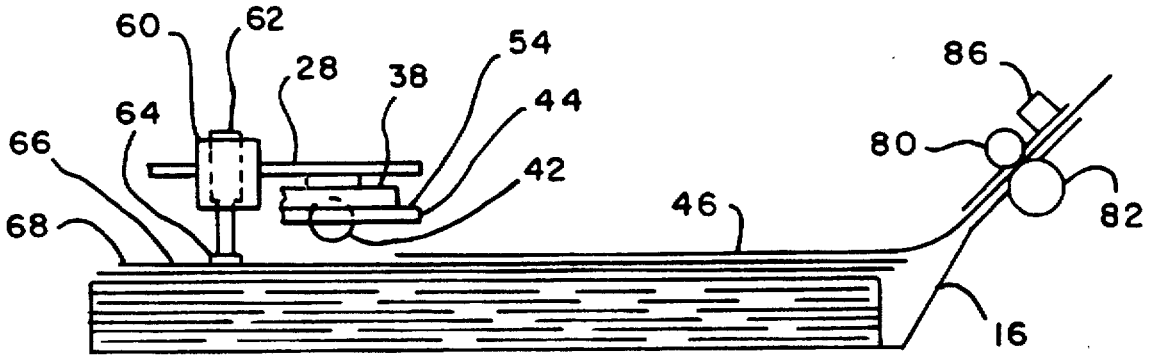
FIG. 4 is a view similar to FIG. 3 showing the top sheet being fed forwardly just after the separating and feeding device has received a feeding command from a central microprocessor, with the retaining means in its lower retaining position on the exposed upper surface of the next to top sheet.
Figure 5:
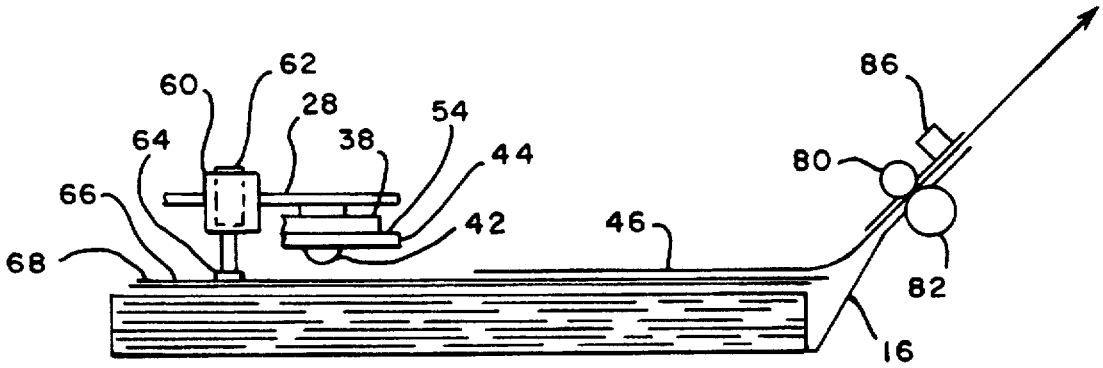
FIG. 5 is a view similar to FIG. 4 showing the top sheet in a more advanced position than that shown in FIG. 4.

Thus, with reference to FIG. 4, when the sheet processing apparatus with which the device 10 is utilized calls for a sheet, the microprocessor energizes the solenoid 60 to lower the plunger 62 so that the pressing pad 64 engages the exposed surface portion 66 of the next to top sheet 68, and after a brief delay to ensure that the next to top sheet is securely held in place, the microprocessor energizes the feed rollers 80 and 82 to feed the top sheet 46 into the sheet processing apparatus. The extent of vertical movement of the plunger 62 is greater than the vertical clearance of the pressing pad 64 with the next to top sheet 68 when the plunger 62 is in its upper or inoperative position, with the result that the supporting member 28 is raised a sufficient distance to lift the elongate supporting member 28 to disengage the rollers 42 from the top sheet, thereby removing the normal force from the weight of the wave generating device 24 from the top sheet 46, as seen in FIG. 4. The sheet 46 is removed from the separating and feeding device 10 and fed into the processing apparatus, as seen in FIG. 5.

Figure 6:
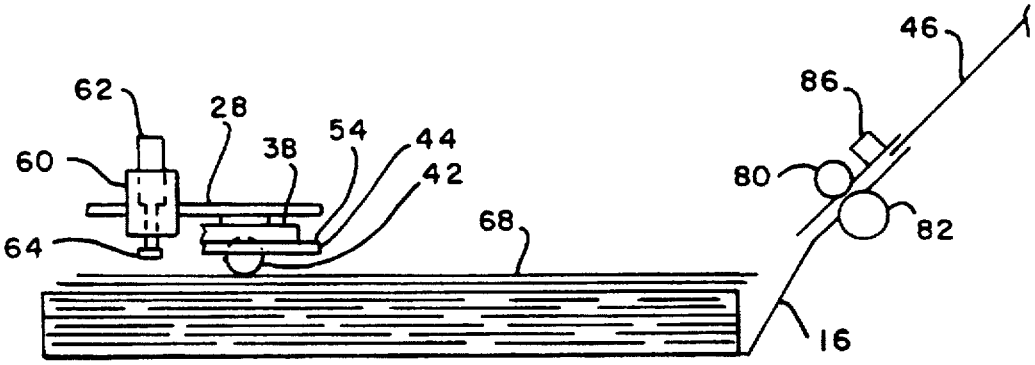
FIG. 6 is a view similar to FIG. 3 showing the top most sheet in a still more advanced position and having been removed from the stack, and the retaining means having been moved to its upper non-retaining position.
Figure 7:
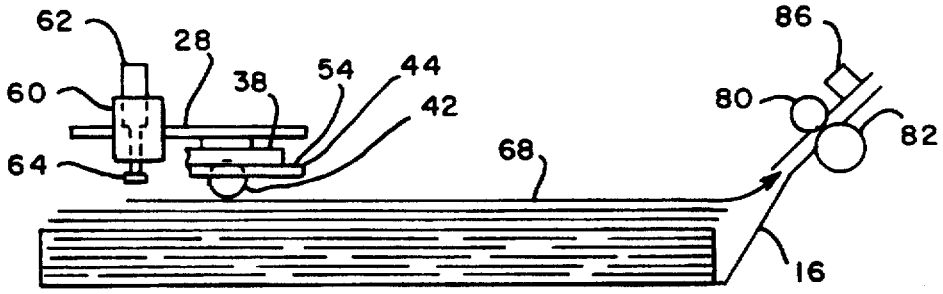
FIG. 7 is a view similar to FIG. 3 showing the new top most sheet being advanced by the rotary wave generating feeding device to move the new top most sheet from its shingled position on the stack toward the staging position shown in FIG. 3.

When the trailing edge of the top sheet 46 reaches the sensing means 86, as seen in FIG. 6, it sends a signal to the microprocessor, which deenergizes the solenoid 60 so that the plunger 62 is raised, thereby permitting the supporting member 28 to return to its normal position so that a roller 42 contacts the upper surface of the new top sheet 46 (which was the next to top sheet 68 in FIGS. 3 through 5), and simultaneously energizes the motor 46 to cause the disc 44 to rotate, thereby setting up directional wave pulses in the new top sheet 46 to separate it from the next sheet and feed it toward the feed rollers 80 and 82. When the leading edge of this sheet is engaged by the feed rollers 80 and 82, it is fed further forwardly until the leading edge is sensed by the sensing means 86, at which time the sheet is again in the home position illustrated in FIG. 3. The sensing means then sends a signal to the microprocessor indicating that the new top sheet 46 has reached the staged position and deenergizes the rollers 80 and 82 to stop the sheet in this position, thus completing one cycle of operation of the device 10.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

I claim:

1. A sheet separating and feeding device for separating the top sheet from a stack of sheets and feeding it in a desired direction, said device comprising:

A. means for supporting a stack of sheets;

B. first feeding means for feeding said top sheet from said stack to an advanced position in which a trailing edge portion of the next to top sheet is exposed beyond the trailing edge of said top sheet;

C. means mounting said first feeding means in overlying relationship with said stack of sheets so that said first feeding means normally contacts the top sheet;

D. second feeding means disposed adjacent said supporting means for grasping the leading edge of said top sheet and for withdrawing said top sheet from said stack;

E. retaining means for engaging said exposed trailing edge portion of said next to top sheet for imposing a retaining force on said next to top sheet and additional sheets thereunder in said stack and simultaneously for disengaging said first feeding means from said top sheet while said second feeding means withdraws said top sheet from said stack; and F. control means for controlling the operation of said first and second feeding means and said retaining means such that said first feeding means is operative to feed said top sheet when said retaining means is inoperative, and said first feeding means is inoperative and said retaining means is operative when said top sheet is grasped by said second feeding means for removal from said stack;

whereby said retaining means prevents said second feeding means from withdrawing more than one sheet at a time from said stack; and wherein said control means further comprises:

(i) means for activating said first feeding means upon demand to feed said top sheet toward said second feeding means;

(ii) sensing means for sensing when the leading edge of said top sheet reaches a predetermined position; and (iii) means responsive to operation of said sensing means for activating said retaining means to move said contact member from said inoperative position to said operative position thereby raising said support means to deactivate said first feeding means.

2. A sheet separating and feeding device as set forth in claim 1 wherein said mounting means includes means for supporting said first feeding means for limited vertical movement relative to said stack of sheets sufficient to permit said first feeding means to be periodically disengaged from said top sheet.

3. A sheet separating and feeding device as set forth in claim 2 wherein said mounting means further includes means for supporting said retaining means adjacent the trailing edge of said top sheet relative to the direction of movement of said top sheet.

4. A sheet separating and feeding device as set forth in claim 3 wherein said retaining means is disposed on said mounting means relative to said trailing edge of said top sheet such that said retaining means engages the exposed upper surface of said trailing edge portion of said next to top sheet to retain said next sheet from movement when said top sheet is engaged by said second feeding means.

5. A sheet separating and feeding device as set forth in claim 4 wherein said retaining means comprises sheet contact means mounted for limited vertical movement relative to said top sheet between an inoperative position in which said contact means is out of contact with said next to top sheet and an operative position in which said contact means is engaged with said exposed upper surface of said next to top sheet.

6. A sheet separating and feeding device as set forth in claim 5 wherein A. said mounting means comprises support means for said first feeding means and said retaining means, said support means being mounted on said sheet separating and feeding device for limited vertical movement relative to said top sheet, and B. said vertical movement of said contact means from said inoperative position to said operative position is sufficient to raise said support means a sufficient distance to disengage said first feeding means from said top sheet.

* * * * *